United States Patent [19]

Blain et al.

[11] Patent Number: 4,785,914

[45] Date of Patent: Nov. 22, 1988

[54] ELEVATOR SYSTEM LEVELING SAFEGUARD CONTROL AND METHOD

[75] Inventors: Jeffrey W. Blain, Scenic Lakes Township, Sussex County; Richard H. Ludwig, West Caldwell, both of N.J.

[73] Assignee: Westinghouse Electric Corp., Pittsburgh, Pa.

[21] Appl. No.: 64,913

[22] Filed: Jun. 19, 1987

[51] Int. Cl.[4] ..... B66B 5/02

[52] U.S. Cl. ..... 187/105; 187/113

[58] Field of Search ..... 187/101, 102, 104, 105, 187/113

[56] References Cited

U.S. PATENT DOCUMENTS

| | | | |
|---|---|---|---|
| 3,587,785 | 6/1971 | Krauer et al. | 187/105 |
| 3,882,969 | 5/1975 | Poocameni et al. | 187/105 |
| 4,114,731 | 9/1978 | Faup et al. | 187/105 |
| 4,308,936 | 1/1982 | Caputo et al. | 187/104 |
| 4,367,810 | 1/1983 | Doane et al. | 187/105 X |

*Primary Examiner*—William M. Shoop, Jr.
*Assistant Examiner*—W. E. Duncanson, Jr.
*Attorney, Agent, or Firm*—J. L. Brzuszek

[57] ABSTRACT

An elevator control system with a local area network on the traveling cable and distributed control circuit safeguard for loss of remote microprocessor control with a car door open when floor releveling distance exceeds the landing zone limit. The elevator control circuit is interactive with the car driving apparatus and with the car door circuit so that when the driving apparatus for the car is leveling the car for passenger load weight gain or loss, the car door is signaled to remain open in the zone of the target floor so long as the distance that the car moves is within the elevator safety code requirements. A time delay relay interfaced with an output channel circuit of the microprocessor times out to stop car driving apparatus if the distance limit is exceeded.

11 Claims, 5 Drawing Sheets

ELEVATOR SYSTEM LEVELING SAFEGUARD CONTROL AND METHOD

CROSS REFERENCE TO OTHER APPLICATIONS

The present application is related to the following concurrently filed U.S. patent applications filed Oct. 16, 1987, Ser. No. 07/109,639, by J. J. Blain, et al. and entitled "Elevator System Graceful Degradation of Bank Service"; Ser. No. 07/109,638, by J. J. Blain, et al. and entitled "Elevator System Master Car Switching"; Ser. No. 07/109,640, filed June 19, 1987, by J. J. Blain, et al. and entitled "Elevator System Adaptive Time-Based Block Operation"; and Ser. No. 07/064,915, filed June 19, 1987, by D. D. Shaw, et al. and entitled "Elevator System Monitoring Cold Oil", all of which are asisgned to the same as the present assignee and the disclosures of which are incorporated herein by reference.

BACKGROUND OF THE INVENTION

1. Field of the Invention

This invention relates in general to traction and hydraulic elevator systems, and more particularly, to distributed control circuits and apparatus located at a car which communicates serially by network signals over a traveling cable with a remote microprocessor elevator controller.

2. Description of the Prior Art

Microprocessors may be pre-programmed to satisfy various safety code requirements in a building configuration. Elevator system safety codes are applicable to both traction and hydraulic car drive apparatus, and this has been given recognition in the fact that advances in the state-of-the-art of solid-state control permits the incorporation of safety circuits into elevator systems with some assurance that component failure does not result in unsafe operation. The likelihood of failure of components used in the present day elevator control apparatus has been minimized by the application of materials testing procedures, statistical use extensions, and appropriate service inspections with periodic and special parts replacements.

There is a historical recognition in accident prevention that many types of failure modes can be prevented. The codification of same and the need to meet the elevator safety code requirements, are exemplified in the mandate that an elevator car is not allowed to travel more than a predetermined distance away from a floor with the car doors open. Previously, this requirement was met by floor level detection apparatus mounted on the elevator car, and it was hardwired through a traveling cable to an elevator controller where the signals were interfaced directly into relay safety circuits. With the introduction of microprocessor based elevator controller, the compliance with the safety codes has gradually shifted to implementation of the codes by programs which can cycle through a safety checking function in a very short time interval. The functions of vast number of relays or arrays of relays found in the historic elevator systems have thus been consolidated into the functioning of microprocessors as controllers which can do a vastly superior job of coordinating all of the multiple demands for elevator service with the control of the car movements very efficiently from floor to floor. This includes car speed transitions for a comfortable ride along with landing and releveling operations at any target floor of the building with door control and safety for the passengers being an overriding and consuming concern.

The current realization of advantages through the use of local area networking for bi-directional serial signal transmission permits an even more efficient distribution of car control circuits for car and door functions local to the car. A remote microprocessor elevator controller communicates with the car control circuits over the traveling cable network which provides the car datalink with the elevator controller being further available for corridor fixture communication operations according to allowed U.S. Pat. No. 4,683,989 entitled "Elevator Communication Controller" which is assigned to the same assignee as is the present application, and it is hereby incorporated by reference into the present application and will be hereinafter referred to as the incorporated U.S. Patent.

The incorporated U.S. Patent describes an addressable communication controller which when addressed by a valid input message, prepares a return message which is automatically clocked out of the communication controller by way of its previously enabled return data interface as the next input message is clocked into the controller, regardless of whether the incoming message is addressed to this communication controller or to another communication controller to control the various elevator car located functions along with the various corridor fixture signal information.

One of the principle problems with an elevator system of the type described above is that compliance to the elevator safety code is done mainly through the microprocessor and the program which is executed thereby. This elevator controller is networked to the car control circuits, but it is remote from the car and its passengers who require a safe passage in any event. A problem arises if there if a failure of the microprocessor or a program failure which is not sufficient to derogate the system operation to its shut-down state with a predictable execution of same. Another problem is present if there is a failure in the bi-directional communication network such as a component failure, an electrical short, or a signal-to-noise ratio outside of the operating requirements.

Yet another problem is present with the releveling of car movement after the landing at a floor, should any of the above failures occur, since the elevator controller may have already signalled the car to relevel with the doors open in order to place the floor of the car level with the corridor floor. This is necessary to compensate for a changing passenger and object weight load with inherent car deflection and drive element cycling to overcome such deflection as caused by either the traction roping stretching-shrinking, in a traction elevator system, or hydraulic pump oil compression-expansion, due to the changing load in a hydraulic elevator system.

SUMMARY OF A THE INVENTION

The present invention is a new and improved elevator system and method of the type which uses a distributed control system implemented with electronic circuits located with each car and having input and output signals which are communicated serially over a traveling cable connected to a remote controller including a microprocessor based computer circuit. The microprocessor implements program control functions which incorporate elevator safety operation code that are of the nature requiring that the elevator car is not allowed to move more than a limited distance away from the floor defining a floor zone while the door or doors of the elevator car are open.

In accordance with another aspect of the invention, the elevator system is safeguarded from deviations from elevator safety code operation during car leveling if a signal failure of the microprocessor based computer should occur. A priority sequencing of hardware components interactively determines whether or not the car can be moved with the doors being open. A timed delay is built into the elevator control system which ensures that the car will not travel beyond the defined floor zone with the doors open even if there is a failure which commences after the car is permitted to move.

Advantages of the present invention provide an elevator system which controls car operations during static and dynamic conditions of elevator safety code program sequencing so as to prevent an unsafe or unpredictable car movement to occur which could otherwise result from untimely failure of a distributed processing component, faulty communication channels, or spurious signals in the system.

BRIEF DESCRIPTION OF THE DRAWINGS

The invention may be better understood, and further advantages and uses thereof more readily apparent, when considered in view of the following detailed description of exemplary embodiments taken with the accompanying drawings in which.

DESCRIPTION OF A PREFERRED EMBODIMENT

The invention is a new and improved elevator system and a method of operating an elevator system of the type which uses a distributed control system disposed partly in the elevator car and partly in a car controller disposed therefrom while communicating over a traveling cable, with the car controller implementing program control functions which incorporate elevator safety codes to ensure safe operations including one that the elevator car is not allowed to move more than a limited distance away from a floor at which the doors of the car are open.

The new and improved system and method are described by illustrating only those parts of an elevator system pertinent to the understanding of the invention and supplemental portions of the elevator system have been incorporated by reference to an allowed U.S. patent as signed to the same assignee as the present application.

Accordingly, U.S. Pat. No. 4,683,989 describes an addressable elevator communication controller for controlling full duplex serial communication between various remotely located corridor fixtures and car functions in a controller which controls a central bank of elevator cars. Each communication controller may be placed on a single IC custom chip which may be used redundantly in the elevator system in order to control the various corridor fixtures including hall call pushbuttons and associated indicator lamps, up and down hall call lanterns located at each floor, digital or horizontal car position indicators and status panels located at selected floors, as well as used for elevator car located functions such as the door controller, car position indicator, direction arrows, and the car call pushbuttons and associated indicator lamps.

Figure 1:
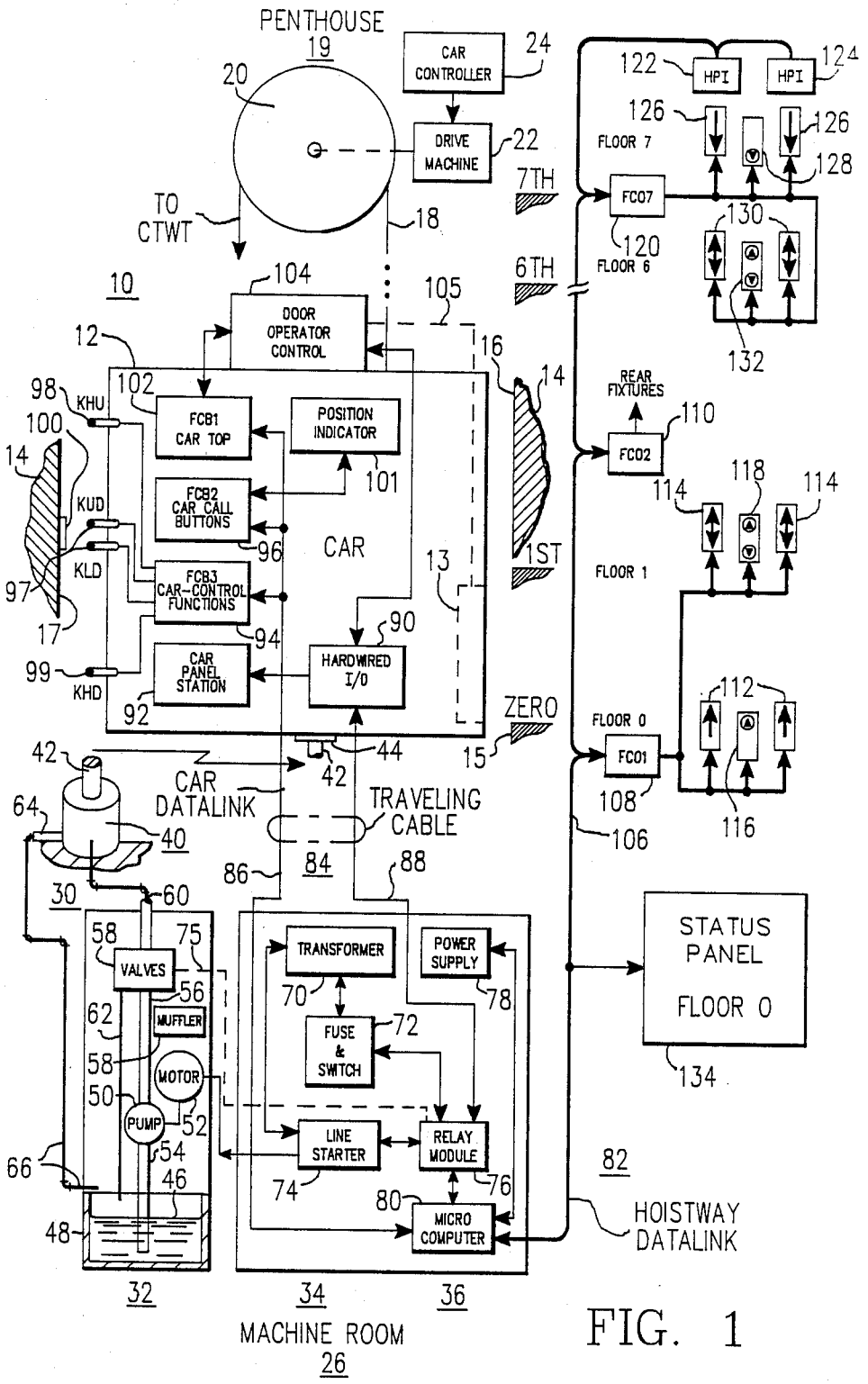
FIG. 1 is a block diagram of an elevator system, shown driven in the alternative with either traction or hydraulic drives which may be constructed and operated according to the teaching of the invention.

More specifically, FIG. 1 shows an elevator system 10 which may utilize the teachings of the invention. The elevator system 10 includes one or more elevator cars, or cabs, such as elevator car 12, the movement of which is alternatively either driven as shown from above the car from a penthouse 12 of a building structure 14 as in a traction elevator system or as shown from below the car in a machine room 26 as when the implementation is in a hydraulic elevator system. When the invention is used in a traction elevator system, the car 12 is mounted in a hatchway of the building structure 14 having a plurality of landings such as 15, with the ZERO 1ST, 6TH, and 7TH floors or landings being shown in order to simplify the drawing. The car 12 is supported by a plurality of layered ropes 18 which are reeved over a traction sheave 20 mounted on the shaft of a drive machine 22 and a counter weight (CTWT not shown) is connected to the other ends of the ropes 18. The drive machine 22 may be an AC system having an AC drive motor, or a DC system having a DC drive motor such as used in the Ward-Leonard drive system or it may use a solidstate drive system.

A traction elevator system is not complete without a car movement detection scheme to provide a signal for each standard increment of travel of the car, such as a pulse for each 0.25 inch of car travel which may be developed in one of several ways such as by a sensor located on car 12, cooperating with a coded tape (not shown) or other regularly spaced indicia disposed in the hatchway 16, 17. Another conventional approach for detecting measured movement of the elevator car 12 is with a governor rope attached to the car and reeved over a governor sheave located above the highest point of travel of the car in the hatchway 16, while a pick-up measures the angular rotation of the sheave which is connected to a pulse control in order to provide distance pulses for a car controller 24 in which resides a floor selector and speed pattern generator for the elevator system.

Car also registered by pushbuttons 96 mounted on the car 12 are provided to the car controller 24 through a car call control and hall calls as registered by pushbuttons mounted in the hallways, such as the up pushbutton 116 located at FLOOR 0, are processed in a hall call control before communicating with a system processor which indicates the hall calls to the cars according to a predetermined strategy for efficient service and effective use of the cars. The system processor is conventionally interposed between the hall call control and the car controller 24 but when it is not operational, the hall calls are directed to the car controller 24 which processes the distance pulses locating the position of the car in the hatch way, and the distance pulses are also used to generate a speed pattern reference signal for the drive machine 22.

A further discussion of a car controller and a traction elevator system of the type which a pulse count is maintained to enable a car to be leveled in the correct travel direction is described in U.S. Pat. No. 4,463,833 which is assigned to the assignee in the present application, and the present invention may be used to enhance the functioning thereof. The present invention, however, will subsequently be described in greater detail with respect to its function in a hydraulic elevator system which is likewise receptive to the method and apparatus concepts of the present invention.

The car controller 24 through its floor selector keeps track of the position and the calls for service for the car 12, and it also provides the starting and stopping signals for the car to serve calls, while providing signals for controlling auxiliary devices such as a door operator control 104 which opens and closes car doors 13 on the car 12. Likewise, the car controller 24 controls hall lanterns such as a hall lantern pair of up floor lanterns 112 associated with the pushbutton at FLOOR 0, and it also controls the resetting of the car call and hall call controls when a car or hall call has been serviced.

The simplification and abbreviation of the elevator system 10 thus far described in FIG. 1 presumes that a traveling cable 84 of the type shown emerging from the underside of elevator car 12, provides bi-directional communication paths to the power and control electronics portion 36 of the machine room 26 which in a traction drive system may be located in the penthouse 19 where it may reside interconnected with the car controller 24.

The power and control electronics 36 may be regarded for the showing of a microcomputer 80 which is seen to be connected to the car 12 through CAR DATALINK 86 in the traveling cable 84 and also connected to the hall fixtures through HOISTWAY DATALINK 82. In the alternative FIG. 1 showing of a hydraulic elevator system 10, equipment in the penthouse 19 is presumed to be no longer present, and likewise, the wire ropes 18 and counter weight CTWT are no longer present since the elevator is driven by a hydraulic system 30 from a hydraulic power supply 32 which is located in the machine room 26 of the building structure 14. The machine room 26 may be located in the basement or subbasement of the structure in order to provide an appropriate direct driving relationship from the hydraulic system 30. This includes a multi-stage or telescopic hydraulic jack 40 which may be of the synchronized type, as which is suitable for use in hydraulic elevator systems. Synchronized refers to the telescopic jack structure with intermediate and plunger sections operated simultaneously with equal movement, as opposed to successive telescopic movement, with trapped oil becoming the medium within the intermediate stages which causes the plunger stage 42 which is fixed to the platen plate 44 centrally located on the underside of car 12 in order to move the car inch for inch according to the movement of the intermediate stage movements of the telescopic jack 40.

Figure 6:
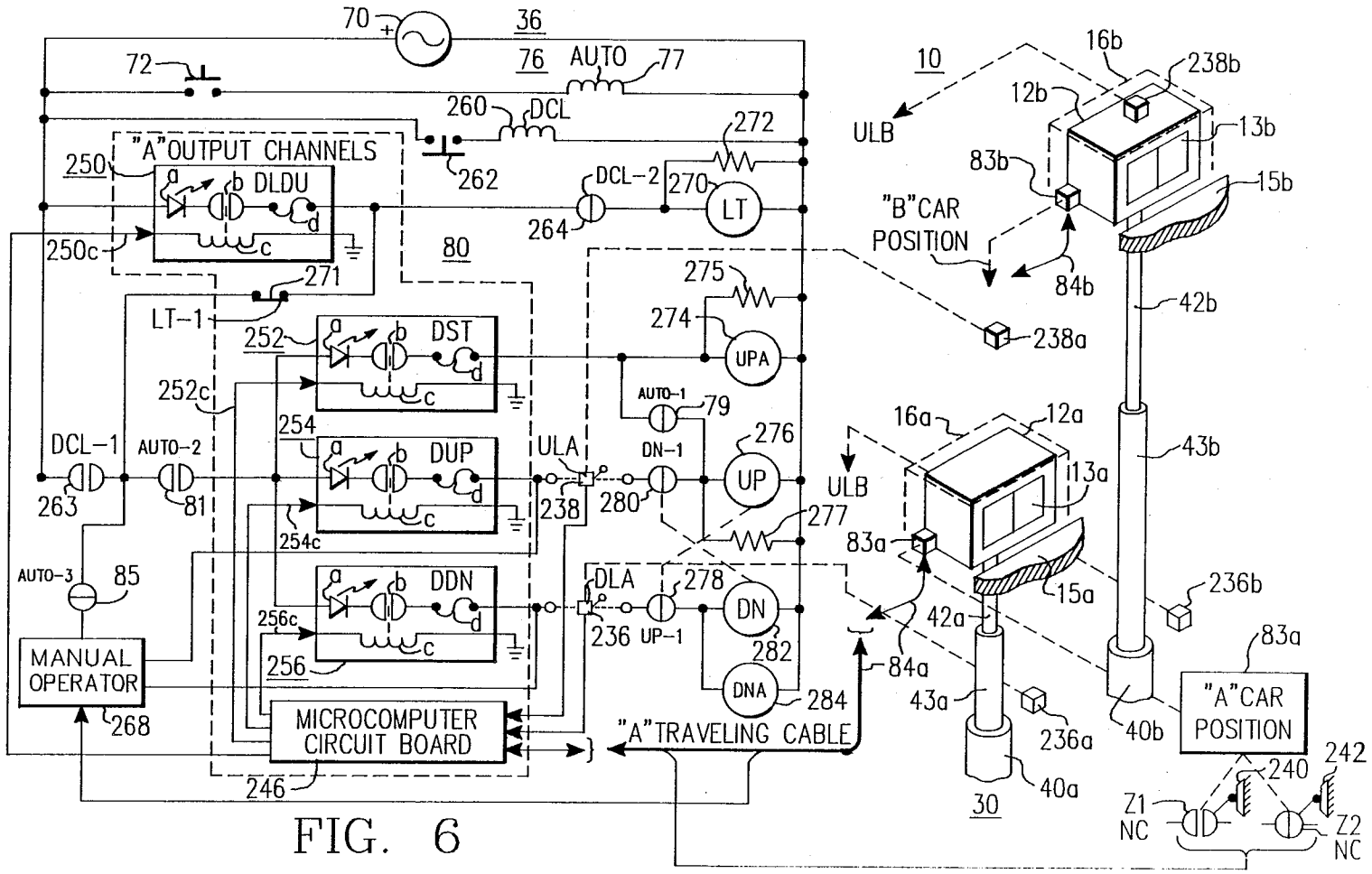
FIG. 6 is a schematic diagram of the present invention, including a microcomputer circuit interfacing with an elevator car on a traveling cable for controlling the operation of the car to a terminal landing floor through safeguarded output channels.

The later discussed FIG. 6 showing a one or two of car hydraulic elevator system 10 provides a readily recognizable version of the multi-stage **42*b*, 43*b* telescopic jack 40*b* extended to nearly its total operating height in a potential hatchway 16*b*** configuration for CAR "B" since CAR "A" may be reaching the top of its vertical assent somewhat lower in the building configuration as represented by this example. A more detailed disclosure of the synchronized hydraulic jack may be seen with reference to U.S. Pat. No. 4,357,995, which is assigned to the same assignee as the present application, although the particular configuration provided by this reference is intended only for exemplary purposes.

The hydraulic system 30 provides fluid power for operating jack 40, such as hydraulic oil 46 disposed in a reservoir 48. A hydraulic pump 50, driven by an electric motor 52, provides hydraulic oil through pipe 54 and out of the pump 50 through intermediate pipe 56 and through a hydraulic elevator valve unit 58 and further through supply pipe sections 60 to power the jack 40 when it is telescopically extended to raise the car from floor-to-floor. The valves 58 include a pipe section 62 for returning hydraulic oil to the reservoir 48. There is also a return oil pipe 64 comprised of pipe sections leading back to the reservoir 48 in order to provide a path for oil leaking past the seals in the telescopic plunger section (**43*a* or 43*b* in FIG. 6) of the hydraulic jack when hydraulic oil is introduced under pressure into the fluid pressure chambers therein when moving the plunger sections 42, 43**.

It is conventional for the electric valves 58 to have electrically controlled up level, up stop, down level, and down stop solenoids, as well as conventional check and relief valves. A remaining component of the hydraulic power supply portion 32 of the machine room 26 is the muffler 58 which is strategically located with respect to the motor 52, pump 50 and valves 58 so as to isolate the vibration which is normally associated with the component power operation of a hydraulic elevator system from reaching the elevator car 12 through the hydraulic jack 40 mechanical linkages which may otherwise transfer vibrations to the discomfort of the passengers.

The machine room 26 also is the location for the power transfer circuits 34 which connect the pump motor 52 to a 3-phase source of alternating electrical potential by way of a circuit breaker and line starter 74. A pump motor 52 is a three-phase motor or a single-phase motor may also be used, as desired, and a suitable control voltage may be obtained from the source of voltage via a transformer 70 through a combined fuse and switching module 72.

The fuse and switching module from the power transfer circuit portion 34 in the machine room 26 also provides power line voltage for a relay module 76 which functions during automatic operation to provide the safety circuit operations through valve driver 75 and also controls the elevator during manual or "hand"

operation, as distinguished from automatic operation, in which the functional responsibility of the microcomputer circuits 80 is relinquished to a human operator to provide overriding directions to the relay module 76. Both of these modules 76 and 80 are powered for logic circuits from a DC power supply 78 which is resident with the power and control electronics portion 36 of the machine room 26.

The microcomputer 80 interfaces to the elevator car 12 through a CAR DATALINK 86 in the traveling cable 84 which terminates in one or more floor control circuit boards FCB1, FCB2, and FCB3 which are functionally designated respectively as car top 102, car call buttons 96, and car control functions 94. The conductors in the CAR DATALINK 86 may be constituted by three pairs of two conductor wires that are twisted and shielded from extraneous noise which might be inductively coupled to the traveling cable since data quality of the transmission signals must be preserved in order to insure the credibility of the information received by the car as it relates to control of the car operation through the floor control circuit boards 94, 96, and 102.

Interfacing to the elevator car 12 from the output of the micro-computer 80 through the relay module 76 is also via the control cable 88 which is also present in the traveling cable 84 and terminates in the hard wired input-output (I/O) 90. The hardwired I/O 90 has an output wired to a car panel station 92 which in turn interconnects internally with the floor control boards 94, 96, 102 therebetween. Another output of the hardwired circuit I/O 90 is connected with a door operator control 104 which receives signals therefrom to control the opening and the closing of the car doors 13 when the car is properly positioned with respect to the floor or floors of the building so that passengers may safely move through the door opening only when the car is properly positioned with respect to the terminal floor 15 at which the car 12 has arrived. The door operator 104 is also signaled into operation by the micro-computer 80 by way of a serial signal transmission path on the CAR DATALINK 86 which arrives at the car top function 102 which in turn communicates with the door operator control 104 to provide a safe mode of door operation through mechanical linkage 105 to car door 13 in order to satisfy a specific code requirements and standards. These standards are presented in the ANSI/ME Safety Code for Elevators and Escalators, which include Section 210.1 e (3), (7) relating to Operation in Leveling and Rule 210.9 (c) relating to Control and Operating Circuit Requirements.

The position of the car 12 with respect to the landing target floor 15 is communicated via the CAR DATALINK to the microcomputer 80 by means of a landing zone detection arrangement that is located and interactive between the car 12 and the hatchway 17. More specifically, detection is with respect to the position of a pair of spaced apart photoelectric landing switches 97 which are also designated KLU and KLD, as respectively interpreted to mean level up and level down. The pair of switches 97 are shown to be in spaced relationship with respect to the face of hatchway 17 upon which a length of reflective tape strip 100 is fastened in a position substantially co-terminus with the vertical linear position of the photoelectric switch pair 97. The length of the reflective strip 100, for example, may be 3 inches long to provide a target mounted at the landing for FLOOR-0 that is a predetermined distance above the landing 15 and which is matched to the span of the distance between the photoelectric pair 97 as relatively located when the car is exactly in position with respect to the floor. This matching detection is to allow the safe transfer of passengers through the elevator door 13 with respect to this floor of the building or any other floor which is comparably equipped.

The independent output of each photoelectric switch in the pair 97 is connected to an input of the floor control circuit board 94 so that a signal can then be communicated over the CAR DATALINK 86 to the microcomputer 80 with the car 12 located very near or at a terminal floor, with each of the eight floors having a configuration with a reflective strip 100 in place on the wall of the hatchway 17 similar to reflective strip 100. It is then possible to accurately position the elevator car at any target landing floor in the building with precision on the order of 0.25 inches which is realized by the arrangement of the switch pain 97 when either of photoelectric switches KLU or KLD do not receive a reflective return from the reflective strip 100 as when the elevator car 12 is linearly displaced upward or downward from the reflective strip 100 by such amount. If the displacement of the ar is upward from the target floor ZERO as now presumed, only the switch KLD will signal the presence of a reflection from the reflective strip 100 since the switch KLU will be above the top of the reflective strip 100 for this car position. Likewise if the car moves downward below the target floor, by a small amount, the switch KLU will be within the reflective zone of the target strip 100 and will signal the floor control board 94 of this position while the switch KLD will not be in a position to receive the reflection of target strip 100 at this location. In both of these deviations of car position, a signal is received by the floor control board 94 from one of either switches KLU or KLD of the switch pair 97 for the distance of car travel in the hatchway 17 of the physical length of the reflective strip 100 on this example for about 3 inches. Thereafter neither KLU or KLD will receive a signal indicating a 3 inch deviation of the car from floor level has occurred.

The reflective strip may serve another purpose other than that of a landing zone leveler for each of the floors of the building when it is used in conjunction with two additional photoelectric switches 98, 99, which are also mounted on the side of the elevator car 12 facing the hatchway 17. The photoelectric switches 98, 99 are positioned on an extended center line above and below the photoelectric switch pair 97 and thus are each in alignment with the reflective strip 100 at FLOOR 0 and with the respective reflective strips at the various floors throughout the building structure. An acceptable deviation from center line is defined in the photo switches to be interactively responsive with each of the reflective strips 100 in the system by the width of the strip which equals its length.

The switch 99, labeled KHD (for down travel), is connected to the floor control board 94 to provide a signal path thereto and likewise switch 98, labeled KHU (for up travel), is similarly connected thereto. The operation of switch 99 is to provide an indication of the direction of car motion when the car is moving in a downward direction in the hatchway 17 with its relative position being lower than the switch pair 97 causing it to first reflectively encounter the landing strip 100 as the car is descending toward the target floor 15 as it is shown in the this configuration. Likewise the position of switch 98 on the car is at a higher elevation with respect to the switch pair 97 and will cause the switch 98 to first encounter the reflective strip at each of the successively higher floor above FLOOR 0 to provide a reflective interaction for the car ascending in the hatchway path so as to signal the floor control board 94 that the car is moving in the upward direction past this level in the hatchway. This information is communicated over the CAR DATALINK to the micro-computer 80 which in turn can signal the relay module 76 that the car is proximate to a target floor so that the motion of the car can be controlled to stop at the designated floor where the car is predetermined to land with a smooth and predictable deceleration pattern. This is accomplished with the slowdown characteristic of the car being a known function of distance which may vary at each floor with respect to the full speed and landing speed characteristic of the hydraulic elevator system so that the car may transition to the landing speed in the landing floor zone and thus make a precision landing within a small fraction of an inch. The relative reflecting position of the switch pair 97 on reflective strip 100 provides the remaining precision necessary in order to land and brake the elevator car 12 at a precise position with respect to any floor of the building. A position indicator 101 is connected inside car 12 to car call buttons 96 to give an indication of its arrival.

Also shown in FIG. 1 is the provision for bi-directional communication paths from the microcomputer 80 to the various corridor fixtures via the HOISTWAY DATA-LINK 82 which is similar to the signal configuration of the CAR DATALINK 86 in that it may be constituted by three pair of two conductor wires 106 which are twisted and shielded from extraneous noise. Otherwise electrical noise could be inductively coupled into this cable and affect the data quality of transmission signals which must be preserved in order to ensure the appropriateness and credibility of the corridor information communicated therethrough. Located in the hatchway 16 at some appropriate position with respect to the Floor 0 and 1ST is shown FC01 a hall fixture circuit board 108 which interfaces between a pair of upward-pointing floor lanterns 112 for Floor 0 which are associated with an UP pushbutton 116 located therebetween at the same floor location. The hall fixture circuit board 108 is further connected to communicate with a pair of upward- and downward-pointing floor lanterns 114 for the 1ST floor and also the UP and DOWN pushbutton set 118 positioned therebetween. The circuit configuration of the hall fixture circuit board 108 bi-directionally communicates with all of the hallway fixtures for two floors and as an additional consideration may also be used to serve a pair of adjoining or separate hoistways not too far physically removed from one another.

Another hall fixture circuit board 110 may also be located between the same pair of floors as hall fixture circuit board 108, but it is intended for the purpose of serving one or both of these floors, 0 and 1ST, at a rear entrance door of elevator car 12 in the structure 14 since elevator systems of this type are in frequent demand for passenger and rear door freight movement between the floors of many building structures. The rear hall fixture circuit 110 provides for the same complement of hall fixture signalling and lighted directional indications of pushbuttons and upward and downward directional arrows as does the hall fixture circuit board 108. Another identical hall fixture circuit board 120 is located in the hoistway 16 at an appropriate position to serve the 6TH and 7TH floors by interfacing the shielded pair conductors 106 of the DATALINK 82 with an upward- and downward-pointing directional pair of floor lanterns 130 and UP and DOWN pushbuttons 132 for this 6TH floor in communication with the hall fixture circuit board 120 on the same communication circuit as the downward-pointing pair of hall lanterns 126 associated with the DOWN pushbutton 128 of the 7TH floor. A pair of horizontal position indicators 122 are also located at the 7TH floor in a position above the pair of down-hall lanterns 126 in order to provide a reading of the location of the elevator car 12 as it transitions the hoistway 16 so that potential passengers who are waiting at the terminal landings of the building structure are given a fair amount of notice of where the elevator car is located with respect to their position in the building so that they may prepare themselves in the appropriate manner to enter the car when it reaches this respective floor or any other which may be likewise equipped with horizontal position indicators of this type.

The position indicators (PI) 122, 124 and the position indicator 101 inside car 12 may be essentially of two different types. The first type is essentially a lamp that is lit or is extinguished when the elevator car 12 reaches the associated floor to provide a visual indication of when the elevator car 12 is at the floor. This is known as a horizontal position indicator HPI as used in 122, 124. A second type of PI is a digital position-indicator which provides a digital readout of a lighted number which corresponds to the location of the car 12 at any floor of the building so as to also display an intelligible indication of the time-distance information so as to better inform the potential riders thereof. It does not provide a specific waiting time since the relative position of the car 12 with respect to any particular floor is not given an assured waiting time because of the contingencies which may occur at any intermediate floor.

Another information display part of the elevator system 10 resides in the status panel 134 which is typically provided in one central location of the building structure 14, and it is usually present in the building manager's office or at the concierge's desk in the lobby of the building. The status panel 134 communicates with the microcomputer 80 via the conductor 106 in the DATALINK 82 in order to provide a display of car position indication such as LEDs for each elevator car 12 in the bank of elevators along with some status indicators indicating which floor is being served by each elevator car 12 and the direction in which it is proceeding.

Figure 2:
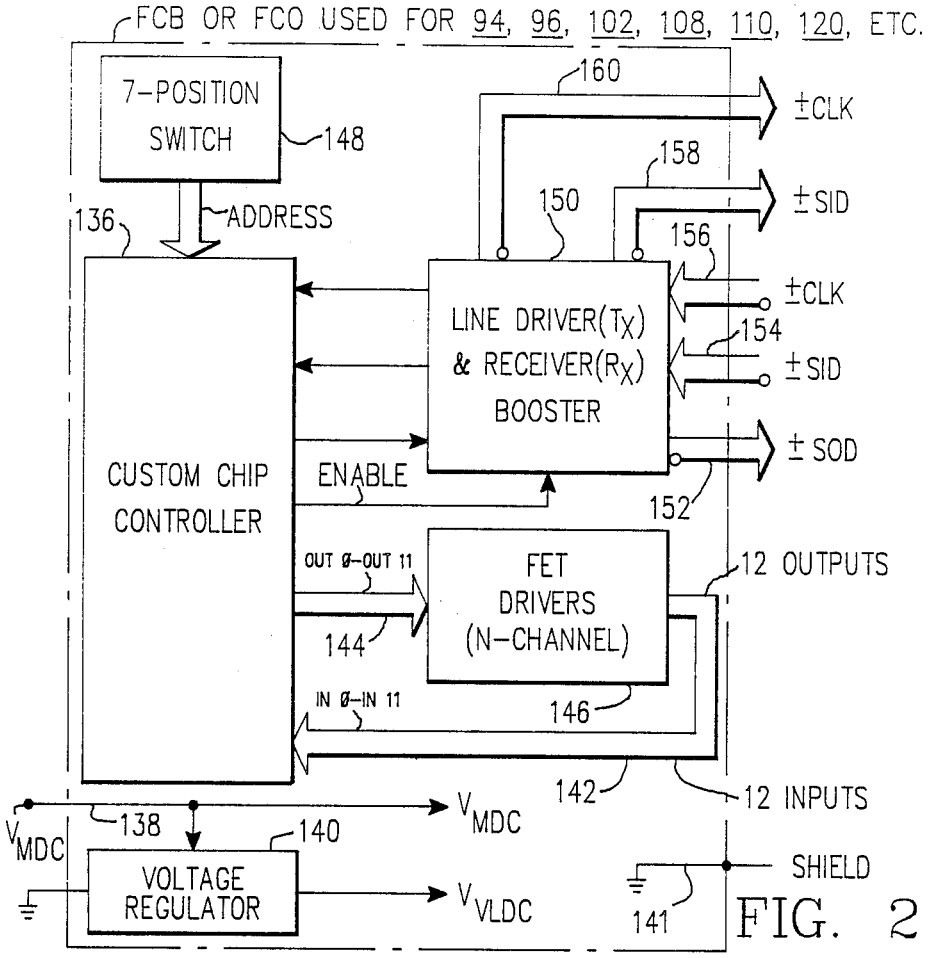
FIG. 2 is a functional block diagram of a control circuit module which may be used to interface with the microcomputer circuit in FIG. 1 via separate datalinks to the elevator car and to the corridor fixtures.

Turning now to FIG. 2 which shows a functional block diagram of a control circuit module which may be used to implement each of the car control circuit board functions FCB3, FCB2, and FCB1, corresponding respectively to blocks 94, 96, 102 which are located in the elevator car 12 described previously. All of these car control circuit board functions are to be interfaced with the microcomputer circuit 80 since this module shown in FIG. 2 includes a custom chip controller 136 which is a semi-custom chip specifically designed to be used as a communication controller in the environment of an elevator system of either the traction or hydraulic microprocessor implemented-type. A plurality of communication controllers of this type is connected to an elevator bank controller, as disclosed in FIG. 1 of the aforementioned U.S. allowed application Ser. No. 06/829,744, filed Feb. 14, 1986, and also is used in the above-described FIG. 1 of the present application, both of which are suitable for incorporating the teachings of the present invention. The communication controller 72 presented in FIG. 1 of the incorporated-by-reference U.S. application is redundantly used as previously mentioned.

The need exists for various supply voltage levels with voltage input terminal 138 providing a medium level voltage $+V_{MDC}$ which, for example, may be a value of +24 v and voltage regulating this potential through a voltage regulator circuit 140 provides a very low voltage potential $V_{VLDC}$ which may be, for example, a regulated +5 v. These voltage potentials provide the power for operating the communication controllers of the incorporated-by-reference application as may be seen in specific detail in FIG. 1 thereof which incorporates in greater detail the schematic circuit diagram therein of FIG. 3 for the digital correlator 90, the schematic diagram of a parity checking circuit 96 of FIG. 5, the schematic diagram of a ring count and divider 104 shown in FIG. 6, the schematic diagram of an enable circuit 100 shown in FIG. 7, the schematic diagram of a shift register data latch circuit 94 shown in FIG. 8, and the schematic diagram of a multiplexer and driver circuit 108 shown in FIG. 10 thereof.

Since a rather complete schematic diagram may be seen in the incorporated reference, it is sufficient for the present application to present only the functional block description in the present showing of FIG. 2. The serial input data ±SID is provided to a line driver and receiver booster circuit 150 of the RS-485 type through input port 154 along with clock pulse input ±CLK through a clock input port 156. Similarly, a transfer data port 158 and a transfer clock pulse port 160 provide an output drive for the serial input data and clock pulses which may be utilized according to the system configuration in which the custom chip controller is implemented. Communication proceeds through the custom chip controller 136 according to an internal configuration thereof set up by a 7-position switch 148 which feeds an ADDRESS thereto which controls the booster circuit 150 as gated by an ENABLE signal to provide the serial output data ±SOD through an output port 152 which may supply the SOD to a line receiver which is resident in a subsequently connected custom circuit chip controller which may also be in the configuration of FIG. 2. Information in the SID is used to drive the output lines 144 which are connected to an N-channel field effect transistor (FET) driver circuit 146 which has twelve output lines corresponding to the corresponding inputs OUT O-OUT 11 to form the inputs 142 to twelve input lines IN O-IN-11 for the customer chip controller 136. A logic 1 in the stream of input data provides a high voltage 5*v level at a corresponding output line 144.*

The functional capability of the block 150 is to transmit $T_X$. The status of the twelve inputs 142 to a controlling circuit and drive its own twelve outputs 144 using the information it receives from the controlling circuit so that the input and output functions of this circuit are general so that input may be the status of car control functions 94, car call buttons 96, door operator status 102, as well as hall call status 112 and output hall lantern indicators 112 through the implementation of same through hall fixture circuits boards 108, 110, 120, etc. The nominal baud rate of 30 KHz for both data reception and transmission speeds is a function of crystal frequency control which is chosen so that the baud rate is within the range of 20 K to 40 KHz.

Figure 3:
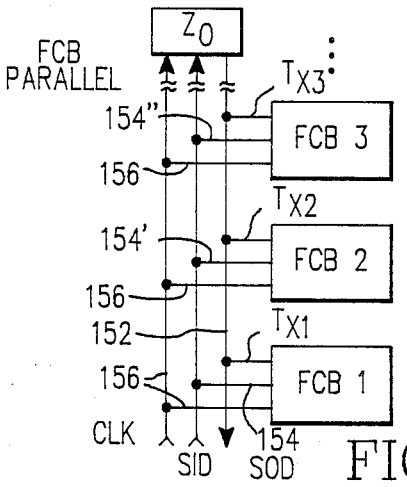
FIG. 3 illustrates an expansion of a datalink connection for input and output clocking of serial information transmission with a parallel circuit connection of control circuit modules.

FIG. 3 shows an expansion of the CAR DATA LINK 86 connected for input 154, clocking 156, and output 152 of serial information transmission for a parallel FCB circuit connection of the control circuit modules designated FCB 1, 2, and 3, respectively and likewise for FC01, FC02 and FC07. A termination impedance 162 is provided having the characteristic impedance $Z_0$ in order to prevent the possibility of reflected tranmission signals which would tend to diminish the signal-to-noise ratio on the traveling cable 84 which serves the CAR DATALINK 86 for the elevator car 12 in FIG. 1.

Figure 4:
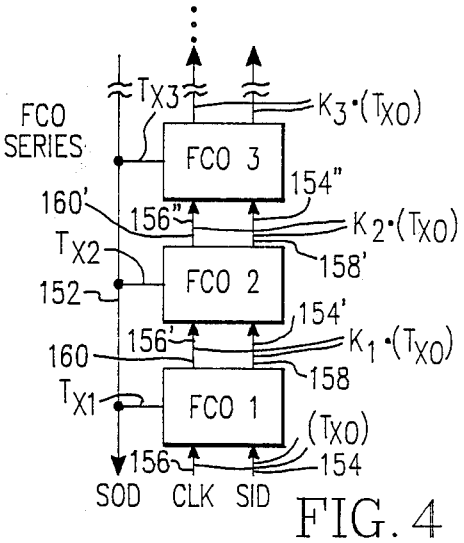
FIG. 4 illustrates an expansion of a datalink connection for input and output clocking of serial information transmission with a serial circuit connection of control circuit modules.

A similar redundancy configuration in FIG. 4 is used in the alternative for some extended configurations. The hall fixture circuits FC0 illustrate an expansion of a data link connection for data input 154, data output 152, and clocking 156 of serial information transmission with the line driver transmission $T_{XO}$ being boosted through the first FD0 in the series by a proportional operator $K_1$. It is subsequently boosted in serial fashion by the remaining serial operators $K_2$ and $K_3$, with the serial output information $T_{X1}$, $T_{X2}$, and $T_{X3}$ becoming respectively clocked out of the modular units on a transmission line such as the conductors 106 of the HOISTWAY DATALINK 82, as represented in FIG. 1. The message structure for a 20-bit frame message has been previously disclosed in the allowed U.S. application which is incorporated by reference so it shall not be repeated here.

Figure 5:
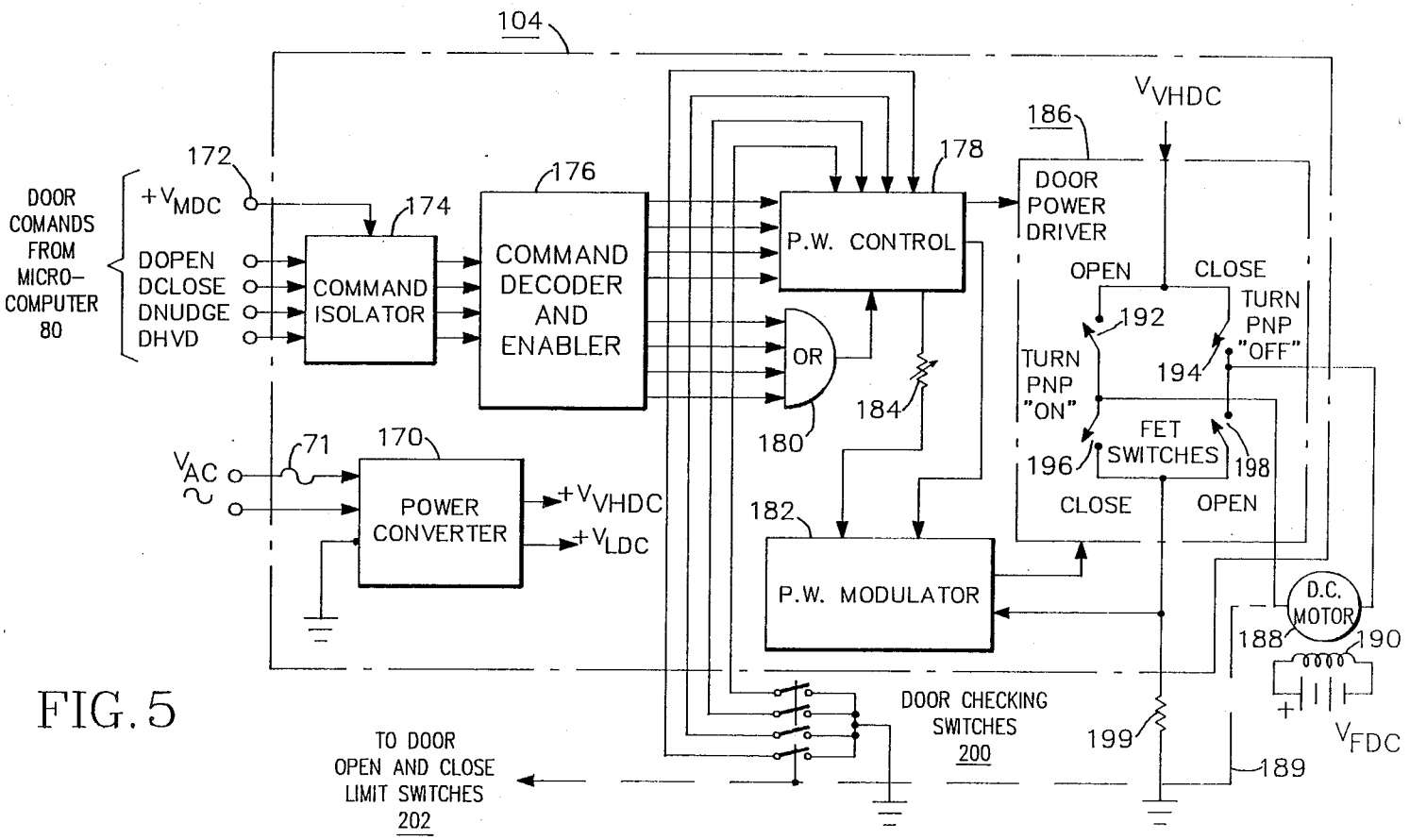
FIG. 5 is a function block diagram partial schematic of an elevator door operator control circuit which may be used for the door operator control shown in block form in FIG. 1.

Coming now to FIG. 5 which shows a block diagram partial schematic of an elevator door operator control circuit 104 which may be used for the correspondingly numbered box located at the top of the elevator car 12 as shown with interfacing connections between the car top floor control circuit board 102 and also interfacing with the hard-wired circuit I/O 90. The door operator control circuit 104 may actually be mounted on top of the elevator car 12 according to a conventional mounting arrangement, or it may take the form of an inside-the-car mounting arrangement which is more easily serviceable to a service elevator repairman who can service most of the door operator control components from inside the elevator car without the apparent need for a top-of-the-car service station. The latter type of door operator control apparatus has been the subject of a U.S. Pat. No. 4,359,143, which is assigned to the same assignee as the present application. The door operator control according to this arrangement is especially suitable for low-cost hydraulic elevator systems which are useful for low-rise buildings, with a further substantial cost savings attributable to the elimination of a drilled hole into the ground by extending the hydraulic jack upwardly through the elevator car via a tunnel structure vertically through a wall of the car which also provides the primary vertical structural member of the car frame according to U.S. Pat. No. 4,356,895 also assigned to the present application assignee.

The door operator control circuit 104 is a solid state control circuit connected to a DC door motor 188 which has a field winding 190 energized by a DC source of power voltage $V_{FDC}$ which may be for example 170 vDC. There are mechanical components associated with the motor-controlled operation of the elevator door 13 which are illustrated by the mechanical linkages illustrated by dashed line 189 from the door motor 188 door positions 13 to a group of door checking switches which is 200 which selectively connect to ground a group of four terminals to a pulse width control 178 which consists of four sets of pulse width adjustments that is electrically implemented by a circuit arrangement of trimpots.

Another mechanical interlocking connection on mechanical linkage 189 is door open and close limit switches 202 (not shown) with mechanical dependence with the door checking switches 200. The door open and close limit switches work in signal conjunction with a group of door command signal communicated to the door operator control 104 over the CAR DATALINK 86 from the microcomputer 80. The main command signals are DOPEN and DCLOSE which are commands to open and close the door, respectively, and further the commands DNUDGE and DHVD which are special modifier commands for the first two commands when there is a condition representing some blockage of the door passageway. The door motor 188 detect the need for the last two commands by encountering some added resistance in fulfilling a DOPEN or DCLOSE command that has been entered for the door operator control circuit 104. The command signals are input to a command isolator circuit 174 which provides electrical isolation of same by the incorporation of photoelectric switches in order to keep the signal return of the door operator control circuit from being coupled into the electrical circuitry of the rest of the microcomputer controlled elevator system. This circuit arrangement provides DC isolation as well as noise protection for the low-voltage logic circuitry or digital parts of the system which may have operating voltage, for example, of +5 v DC. A common voltage for the command isolator circuit 174 is the input terminal voltage $+V_{MDC}$ designated 172 which, for example, may be a 24 v operating voltage.

Another portion of the operating voltages of the door operator control circuit 104 is provided by a power converter circuit 170 operating on 120 v AC, input through a fuse 71, and providing two levels of DC operating voltage potential $+V_{HDC}$ and $+V_{LDC}$. The very high voltage output $V_{VHDC}$ provides the operating voltage for a door power driver circuit 186 which provides the variable armature voltage for the DC door motor 188 which has the fixed field voltage $V_{FDC}$ which may be at 170 v. In this example, the voltage potential supplied to the armature of the door motor 188 may have the maximum value of 170 v. The lower voltage output of the power converter then may be, for example, 12 v or one-half the command isolator operating voltage which may be 24 v for this example.

The command isolator circuit 174 delivers the isolated command signals to a command decoder and enabler circuit 176 which receives the commands and enables the proper set of pulse width controls while detecting command errors, whereupon it may disable the further signalling of the pulsewidth modulation as a self-checking feature. For example, if there are simultaneous command signal receive to both open and close the elevator door 13, the door operator control circuit 104 would become motivated by a conflicting set of operations, both of which could not be executed because of the logical conflict in the apparatus. A first set of four command outputs from the command decoder and enabler circuit 176 is sent to the pulsewidth control 178 in which resistor trimpots therein proportion the door operations for normal and heavy door conditions at various check points detectable through the door checking switches 200 which have been previously identified. Another set of four outputs from the command decoder and enabler circuit 176 are sent through a logical OR circuit 180 which has its output directly connected to the pulse width control circuit 178.

There are three outputs of the pulse width control circuit 178 with the first of them forming a control input to the door power driver circuit 186 which has been mentioned for its function of providing the variable armature voltage to the door motor 188 via the input leads connected to the armature terminals thereof. The other two outputs from the pulsewidth control circuit 178 form a direct input to a pulse width modulator circuit 182, and the remaining input thereto is modified through a resistive trimpot 184 or potentiometer of the type that will provide a range of adjustment of the input signals thereto. The pulse width modulator 182 generates a fixed frequency, variable duty cycle output signal ranging between 0 and 95%. The pulse width modulator output signal is proportional to the voltage from the pulse width control circuit 178, accordingly, with the duty cycle limited by the current limit input therefrom.

The door power driver circuit 186 is functionally represented as an "H-Bridge" circuit that has the characteristic of providing electrical current to the armature circuit of door motor 188 in either direction of electrical current flow thereto. This is achieved by a pair of top legs 192, 194 of the bridge with 192 on the left representing a circuit configuration with three PNP transistors turned on for opening as represented by the open switch. The bridge right leg 194 represents a circuit of three PNP transistors turned on for closing as represented by the open switch. The lower legs of the functional circuit bridge are also represented by switches 196, 198 which are implemented by FET switches 196, 198 which are pulsed by the operation of the pulsewidth modulator circuit 182. The left FET switch 196 is pulsed for closing, and the right FET switch 198 is pulsed for opening. The door power driver circuit 186 is completed with the connection of a current-sensing feedback resistor 199 which senses the armature current of the door motor 188 with a feedback control signal being connected back to the pulse width modulator 182 in order to limit the current for opening the door to a fixed maximum which may be, for example, about 3 amperes of current. The limit of armature current for closing the elevator doors may be set by a trimpot in the circuit of the current-sensing resistor 199 for the value required to limit the door-closing force to a predetermined maximum value.

The command signals DNUDGE and DHVD are commonly referred to collectively as "NUDGE", thus limited by the value of current-limiting which is chosen for the door motor 188 armature current for limiting the door opening and closing forces. Any of these commands are transmitted to the door operator control circuit 104 from the top floor control circuit 102 which may also communicate certain facets of the door operation such as the status of safety edges which prevent the vise grip on a passenger's anatomy caught between closing doors or a door and the car frame. Likewise, safety rays which are transparent except in the door channel with reflection from the sill of the door are available for early detection of a passenger or object still with in the doorway. Door position switches which monitor the progress of a door through its horizontal displacement also communicate to the door operator control circuit 104 the information that comes to the car top floor control circuit 102 which is wired to the car panel station 92, respectively.

FIG. 6 shows an illustrative embodiment of the present invention as interrelated with the components of the elevator system introduced in the FIG. 1 block diagram shown driven with the alternative hydraulic system 30 which may be used redundantly. A multiple car system provides that each car 12*a*, 12*b* is driven by a multistage telescopic hydraulic jack 40*a*, 40*b* with respective intermediate plunger sections 43*a*, 43*b*. The uppermost plunger section 42*a*, 42*b* provides the driving contact with each car 12*a*, 12*b* in the respective hatchways 16*a*, 16*b*. Each of the cars is similarly equipped with a car position detector 83*a*, 83*b* which communicates over the respective TRAVELING CABLE 84*a*, 84*b*, although the showing of the cable 84*b* for the "B" car is abbreviated as redundancy with regard to the "A" car traveling cable would allow without ambiguity.

A lower limit flow switch 236*a* is positioned in the hatchway 16*a* below the car floor position 15*a* which represents an intermediate floor in building structure as indicated by the telescopic extension of the hydraulic jack plunger extensions 42*a*, 43*a*. An upper limit floor switch 238 is positioned above the floor position 15*a*, not substantially removed from a projection vertically upward from the lower limit floor switch 236*a* since perfect vertical alignment of the switches is not necessary to their proper functioning. This positioning is designed to provide a lower an upper limit to the vertical extent of the movement of the elevator car 12*a* which corresponds to the lowermost and uppermost positions of the elevator car in the hoistway 16*a* which may correspond to the Floor 0 and Floor 7 corresponding to the showing in FIG. 1. Intermediate positions for the elevator car 12*a* at intermediate floors can be tracked through information received via the "A" car traveling cable connection 84*a* which communicates the information available from the car position detector 83*a* with respect to its physical position with respect to a cam 240 associated with open switch contacts Z1 and a cam 242 associated with the closed switching contacts Z2. Car position signals relative to the landing zone adjacent to each floor may be provided by cams and switches of this type with the cams 240, 242 disposed on suitable cam tapes (not shown) strung in the hoistway 16*a* with the cams being attached to the tapes adjacent to each floor and the respective switching contacts Z1, Z2 being mounted on the elevator car 12*a*.

Switching contacts Z2 contacting cam 242 may define the limits of the landing zone which will be assumed to extend 6 inches in each direction from floor level. The switching contacts Z2 are normally closed and open only when the floor of the passenger compartment of elevator car 12*a* is within the landing zone of ±6 inches from the target floor 15*a* at which the elevator car 12*a* is preparing to make a stop. The switching contacts Z1 are normally closed and open only when the elevator car is within ±0.25 inch of the floor level which is the position assumed for the elevator car 12*a* with respect to floor 15*a* since the normally closed contacts of Z1 are shown in the open position. This introduction to the invention is facilitated by the above switching analogy for car position in the landing zone as it is represented by the information available from the switching contact status of Z1 and Z2 which is communicated on the "A" car traveling cable 84*a* and forms one of the serial information inputs to a microcomputer circuit board 246 which is resident within the microcomputer 80 in the machine room 26 as also described with respect to FIG. 1. The implementation by switching contacts to provide the appropriate position detection signals as such is not specific to the present invention since the same signals may be developed opto, electronically as disclosed in U.S. Pat. No. 4,019,686 or in the manner represented in the present application by the photoelectric landing switch pair 97 in conjunction with the reflective corridor landing strip 100 and landing direction switches 98, 99 respectively or in some logical combination of the above.

FIG. 6 shows within the footprint of offset rectangles defining a perimeter around the microcomputer 80, a group of "A" Output Channels 250, 252, 254, 256 which are associated with the microcomputer circuit board 246 and which are resident in closely spaced association for electric circuit operation therewith. The output channel blocks 250–256 are functionally representative of a type of solid state electronic device which is capable of switching high or line voltage AC relays electrically in circuit therewith between off and on states of operation. Gating logic voltages are used are relatively low DC values of the type that are normally associated with microcomputer devices such as circuit board 246 in the present circuit arrangement. Those solid state transistor devices are resident on a single integrated circuit (IC) arrangement which may use that type of device known in the art as Silicon Control Rectifiers (SCR), Also useful are Triacs, Thyristors, and, more recently, Gate Turn-Off devices (GTOs) which is an enhanced solid-state device, to provide the capability of starting and stopping the flow of high voltage AC waveforms within a fraction of a cycle of the 60 Hz waveform. The GTO thus performs a more precise degree of control which is necessary under certain circumstances. The requirements of the present invention do not mandate the use of any one of these particular devices to the exclusion of the others in the group since a timing requirement may be implemented for system operation which is acceptable according to the related ANSI/ASME Operating Standards, previously cited as Section 210, despite the relative time requirements of each of the devices mentioned in the above grouping.

Consider in FIG. 6 the output channel 252 which is fairly representative of a circuit achievable with the above class of devices, three elements in series circuit are recognizable in their functional respective functional character as a light-emitting diode (LED) 252*a*, a set of normally open contacts 252*b* which are controlled by a switching coil 252*c*, and a series fuse 252*d*. The acronym within block 252 is as "DST" which will be used to represent the functional characteristic of this output channel 252 which is used to start the operation of the motor 52 in FIG. 1. The motor 52 in turn starts the pump 50 to push hydraulic oil through valves 58 in order to provide the telescopic action of the hydraulic jack 40*a* as already described. A UPA relay coil 274 is connected to the output of output channel 252, and this relay coil 274 is resident in the relay module circuit 76 along with a parallel circuit resistor 275 connected across the relay coil 274. The operation of DST output channel 252 is such that when a control signal from the microcomputer circuit 246 energizes input coil 252*c* to cause contacts 252*b* to close and provide an operating voltage of line voltage or about 120 v AC across the relay coil 274 which provides a voltage through line start 74 to start the motor 52 to power the associated pump 50. It should be generally noticed that output channel 254 is likewise associated with a relay coil 276 which is designated UP and which controls the hydraulic valve resident in the hydraulic elevator valve unit 58 for movement of the elevator car 12*a* in the upward direction from its reference position. A parallel circuit resistor 277 is placed across the relay coil 276 in the relay module circuit 76 in order to provide proper current-limiting in response to the operating value of AC voltage thereacross when the respective operating channel DUP is signaled into operation. The control operating DC signals are sent to the respective output channels 254, 252 on 254*c* and 252*c*. Another output channel 256 is designated DDN and is associated with a relay coil 282 in a manner similar to the previously described output channels. In this circuit, the DDN output channel 256 controls the release of hydraulic oil from the telescoping hydraulic jack 40*a* through supply pipe sections 60 and through open valves 58 which are opened by DN being energized. This allows gravity to drop the hydraulic oil through the return oil pipe sections 62 into the reservoir 48 when the motion of the elevator car 12*a* is signaled downward in the hoistway 16*a*. Another relay coil 284 is connected in parallel circuit with the relay coil 282 which substitutes for a parallel circuit resistor to provide the appropriate AC current flow therethrough.

An additional benefit is gained from satisfying system redundance according to the requirements of section 210.9 of the ANSI/ASME Code relating to Control and Operating Circuit Requirements to ensure that a single failure does not permit the car to start or run unsafely under these circumstances.

The lower limit floor switch 236*a* has a contact set 236 interposed in the circuit between output channel 256 and relay coil 282 in electrical series with a contact set 278 functionally designated UP-1. The upper limit floor switch 238*a* has a set of contacts in like manner disposed between the output circuit of output channel 254 and relay coil 276 in series circuit with a set of contacts 280 functionally designated DN-1. The operation of the lower and upper limit floor switches provides status signal DLA and ULA to the input of the microcomputer circuit 246 so that the operation of the system provides a limited safe movement of the elevator car 12*a* between these set limits. A lockout is provided to the DDN output channel 256 by the strategic positioning of a set of UP-1 contacts 278 as controlled by the UP relay coil 276 when it is energized by the DUP output channel 254. The normally closed contacts 278 are opened in the circuit of output channel 256 so it cannot conduct to provide concurrent energization of the relay coil 282 with relay coil 284. This avoids a conflict in the UP valve control 276 and the DOWN valves control 278 so both cannot be operated open to in the hydraulic elevator valve unit 58 through some failure of the system to function properly. A similar lockout is provided to the DUP output channel 254 by a set of DN-1 contacts 280 controlled by the DN relay coil 282. This cross-coupled checking arrangement illustrates the certainty which is provided in the system so that the microcomputer circuit board 256 in conjunction with the output channels 254, 256 provides inherent redundancy with interlocking arrangements of switching contacts, although the vast majority of relay contacts heretofore necessary for meeting all of the Code safety requirements has been obviated by implementing their functions through programming the safety code requirements into the microcomputer circuit board 246. The establishment of appropriate supporting relays and circuits are further designed to safeguard the a distributed processing system which is located partly in the machine room 28 and partly in the elevator car 12 and hoistway to complete the system.

An elevator system has two general classes of operation which are known as automatic operation and manual operation. The manual operation will be described first because it is briefly disposed of in the context of the present invention. Manual operation in FIG. 6 presupposes that the doors 13*a* of the elevator car 12*a* are safely in the closed position before the car may be moved upward or downward from a terminal floor position such as 15*a*. A door control relay coil 160 is shown in electrical series circuit with an operating switch 262 which when closed energizes the coil 260 with the line AC voltage 70. A set of normally open contacts 263 are functionally designated DC-1 and close when relay DL is energized to indicate that the elevator doors are in a the closed position which is associated with the manual operation. A similar circuit arrangement across the AC voltage 70 is shown for the relay coil 77 functionally designated AUTO. A series circuit switch 72, is not closed assuming the car is to be operated manually.

The AUTO switching contacts which are actuated by the relay coil 77 in automatic operation are designated 79, 81, and 85, and are each shown in their normal proper contact condition for manual operation. Manual operation may be put into use for various functional reasons and from different locations in the system such as from the elevator car panel 12*a* in which event an associated signal is communicated via the traveling cable 84*a* to a manual operator circuit 268 which has a pair of outputs that are connected respectively to the output of the output channels DUP and DDN. This circuit connection provide a control signal which bypasses the output channels DUP, DDN normally associated with automatic operation in order to provide the energization of the UP and DN relay coils 276 and 282 for the proper valving operation to provide the desired manual control. The contacts 85 functionally designated AUTO-3 are in the closed state for the de-energized relay coil 77, and switching contacts 263 functionally designated DCL-1 are normally open except when the doors are closed which is the assumed state for energized relay coil 260. The AC line voltage 70 is thereby connected through the manual operator circuit 268 which may include pushbuttons or remotely controlled switches to transfer the line voltage across the UP relay coil 276 or the DN relay coil 282 alternatively as far as possible and within the hoistway limit switch limits of operation.

The first output channel 250 was functionally designated DLDU which has a special significance and is yet to be described in its association with the operation of the safety requirements of the elevator system. The input of the output channel circuit 250 is directly connected to the positive terminal of the line voltage source 70. The output of output channel 250 is connected to a set of contacts 264 functionally designated DCL-2 which are normally closed when the door of elevator car 13*a* is open. A relay coil 270 functionally designated LT is connected in series circuit across the line voltage 70 only when the output channel 250 is energized by the microcomputer circuit 246 signaling for contact closure through the functional coil 250*c*. A current-limiting resistor 272 is connected in parallel circuit across the relay coil 270 in order to provide the proper level of operating current accordingly. The relay coil 270 is a "delay for on operation" which functions to control its normally open LT-1 contacts 271 to the closed circuit position for a predetermined period of time which may be measured in seconds. After the relay coil 270 times out, contacts 271 return to their normally opened condition.

Automatic operation of the elevator system is normal under the usual circumstances, assuming that there are no failures in the system which would preclude automatic operation. Thus, with switch 72 in the closed position, the relay coil 77 for AUTO operation will be energized and AUTO-1 contact 79 will be open while AUTO-2 contacts 81 will be closed. Because AUTO-3 contacts 85 will be open, manual operation will not be possible. The doors of the elevator car will be closed while the car 12*a* is transitioning between its position at one floor previous to landing at a designated terminal floor to which it has been signaled either for movement in the upward or downward direction. Therefore with switch 262 closed and DC relay coil 260 energized, the DCL-1 contacts 263 are closed and in series circuit with closed AUTO-2 contacts 81, as previously mentioned, which provides a circuit path for energization to respective functional output channels on DST, DUP and DN. The first two output channels DST, DUP are alternatively or simultaneously energized from the microcomputer circuit 246, depending on whether or not both the UPA motor control relay coil 274 and the UP hydraulic valve relay coil 276 are to be energized individually or simultaneously. This configuration with AUTO-1 contacts 79 open during automatic operation provides the microprocessor with the ability to operate the motor and the UP hydraulic valve separately. There is no like need for the down direction of operation, and there is concurrent energization of DN relay coil 282 and DNA relay coil 284 since there is no need to run the motor with gravity providing the necessary force for downflow operation.

The DLDU output channel 250 becomes operative only during automatic operation as when the elevator car 12*a* lands at a terminal floor within ±0.25 inches and opens its doors 13 so that passengers may either get on the elevator car or get off. The only other choice for the passengers in the car is to remain in the car which will not inhibit the analysis which follows. The doors 13*a* of the car have been signaled to open, the DC relay coil 260 is de-energized and DCL-1 contacts 263 are in an open state according to the convention previously discussed. The DC-2 contacts 264, however, which were previously open during the time the doors were closed, are now in their closed state when the DC coil 260 is de-energized. If there is a change of weight in the car due to the movement of passengers into or out of the car, it may be desirable that the car relevel at the terminal floor so that there is a uniform position of the car floor with respect to the terminal floor 15*a*. The passengers and the prospective passengers should not be suddenly confronted with an obstacle which would cause them to trip if they were not to notice that the car had moved vertically upward or downward while they were transitioning from the corridor to the car or vice versa.

If additional passengers enter the car, the weight of the car with the passengers increases and may compress the oil in the plunger sections 42*a*, 43*a* of the hydraulic jack 40*a* so as to deflect the car vertically downward. Likewise, if the number of passengers leaving the car is not replaced by an equal weight of passengers entering the car, the car may deflect upward from the terminal floor by an amount caused by the expansion of the hydraulic oil in the hydraulic jack 40*a*. Under these circumstances, the automatic operation of the elevator system will permit the car to relevel with the doors 13*a* to remain open during the releveling provided that the operation of the motor 52 and valves 58 is such as to compensate for the deflection either upward or downward within a period of time not to exceed a specific time interval such as three seconds. The distance from the landing floor with the door open to be in no event greater than ±3.0 inches measured with the car floor initially at the same level as the terminal floor. With these landing terminal distances and timing of operation setting the standard for a microprocessor control elevator system, the "delay time for on operation" for LT relay energization is about three seconds during which time LT-1 contacts 271 are closed, thereby bypassing DCL-1 contacts 263 for line voltage 70 to be applied through closed AUTO-2 contacts 81 during automatic operation. The microcomputer circuit 246 initiates this LT relay coil energization by providing a logic signal input to DLDU output channel 250 on coil 250*c* thereby closing the associated contacts 250*b* once every three seconds while the car 12*a* is within the ±3.0 inch limits for as long as it is necessary to relevel the car at the terminal floor 15*a*. The only way to move the elevator car once the time "delay time for on operation" of LT relay coil 170 has been de-energized and the car is passed the ±3.0 inch limits is for the door 13*a* of the elevator car to close by energization of the DCL coil 260. This action opens the DC-2 contacts 264 which inhibit any further operation of the DLDU channel 250, and thus it is not possible for LT-1 contacts 271 to be other than in an open state once this transition has occurred, unless the car 12*a* again lands within the ±0.25 inch landing zone.

Figure 7:
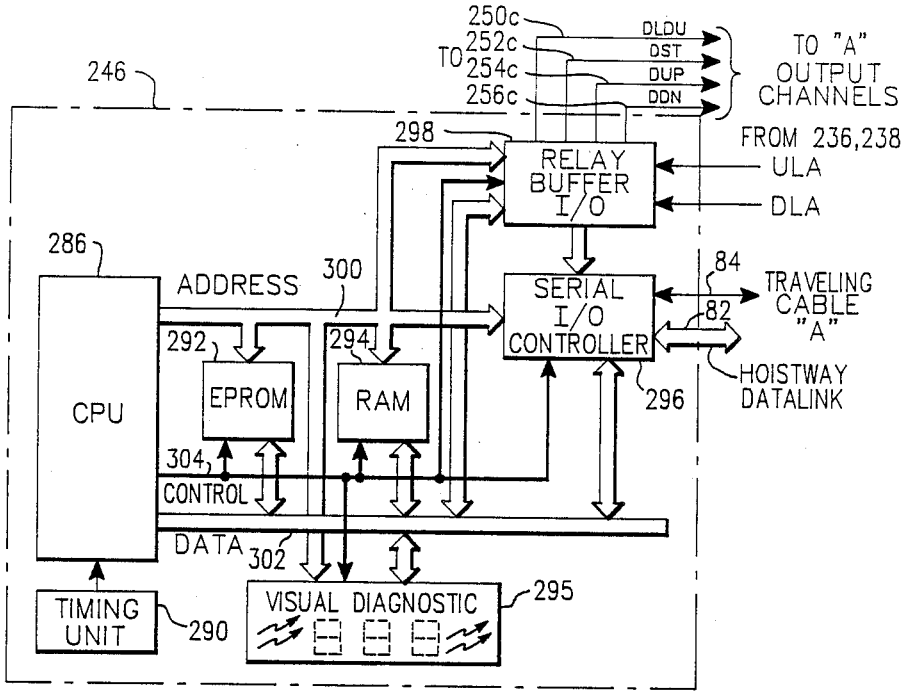
FIG. 7 is a block diagram of a microcomputer circuit which may be used in the elevator system of FIGS. 1 and 2.

FIG. 7 shows the micro-computer circuit in block 246 of FIG. 6 in a more detailed block diagram which is a special purpose microprocessor-based controller designed to control the overall operation of a single car in a hydraulic elevator system and to control the operation of the elevator cab in a traction elevator system. A central processing unit (CPU) 286 is the controlling block of the microprocessor. The CPU 286 is a highly integrated member 8-bit CPU that may be designed to operate at 6 MHz operating speed. A CPU of this type is available from Intel with a Model No. 80188, and it is provided with a Timing Unit 290 having a 9600 Hz clock channel but which is not used for this purpose. Also in the circuit 246 with the CPU 286 is an EPROM memory 292 split into two sections which can both either be 32K or 16K bytes of the same type of programmable "read-only" memory. Another data storage device in the circuit 246 is the random access memory (RAM) 294 which can provide 8K bytes of data storage of a non-volatile type which can retain approximately 2K bytes of data in extended long-term storage in the absence of any operating supply voltage except for a long-term shelf life storage battery. A visual diagnostic module 295 is provided to indicate the status of the microcomputer circuit 246 in its various states of operation or servicing. The diagnostic module 295 provides a multi-segment display of digital readout indications which may be, for example, a 7-segment display and also multiple light-emitting diodes (LEDs) which are software-defined to provide ON and OFF light-emitting states. These diagnostic configurations are characteristic of predetermined operating functions and failures in the system in order to visually diagnose the status of the microprocessor circuit 246 as it interacts with various components and safety code operation of the elevator system.

The EPROM 292 and RAM 294 along with the diagnostic module 295 communicate with the CPU 286 over an ADDRESS bus 300, DATA bus 302, and CONTROL 304 from the CPU 286 which are likewise used for an input and output of information to devices which communicate with the external portions of the system by way of communications networking and higher voltage interfacing. The busses 300, 302 and control line 304 are also in communication with a relay buffer input-/output circuit 298 which is a high voltage interface to the relay coils associated with the relay module 76 shown in FIG. 1 and shown in more detail in FIG. 6 to include generally the inputs to "A" output channels 250*c*, 252, 254*c*, 256*c* and the ULA, DLA relay inputs 238, 236 from correspondingly designated contacts which are individually associated therewith. The hoistway lower limit switch 136*a* and upper limit switch 238*a* provide contact closure in the high voltage circuit paths shown in FIG. 6 for the UP relay coil 276 and DN relay coil 282 to provide relay input information. A serial input/output (I/O)communication controller 296 also communicates on the address bus 300, data bus 302 and control line 304 with its serial interfacing functions present on its output port. The "A" car traveling cable 84*a* of FIG. 6 includes the CAR DATALINK 86 shown in FIG. 1, the signals communicated over this path include the serial input data ±SID which is clocked through the floor circuit boards FCB 94, 96, 102 by clocking pulses ±CLK and returning serial output data ±SOD to the microcomputer circuit 246. Two independent floor controller links may utilize this same microcomputer circuit 246 for elevator car 12*a* via interconnected HOISTWAY DATALINKS, one of which is shown at HOISTWAY DATALINK 82. The associated hall fixture circuit boards 108, 110, 120, etc., provide the bi-directional communication path with the microprocessor circuit 246 and provide all of the corridor fixture signalling functions such as pushbutton hall calls, visual lanterns, and audible car position signalling.

THe serial I/O controller 196 is a multi-functional communication controller of the transceiver type more appropriately termed a Multi-function Universal Asynchronous Receiver Transmitter (MUART) which is clocked at rate of 3 MHz and is programmed to generate its own baud rate of 1200 Hz. It may be used in conjunction with a Multi Protocol Serial Controller (MPSC) which is also clocked at 3 MHz to provide a 9600 baud rate from a timer output of the CPU 286. These communication controllers allow the microprocessor circuit 246 to handle multiple communication links of, for example, up to five (5) with certain links being capable of enabling and disabling their drivers so that loading of a signal line is avoided. The length of the traveling cable 84 is under 2,000 feet for the number of floors to be serviced in the manner specific to the local area network (LAN) with a packet switching communication configuration.

If the elevator system is a two-car system configuration as shown in FIG. 6, the "B" CAR traveling cable 84*b* is interfaced with another microcomputer circuit which may be identical to circuit 246. Each car 12*a*, 12*b* is located in an adjoining or separate hoistway 16*a*, 16*b* with its respective or joint machine room 26 housing the hydraulic system 30 along with the power and control electronics apparatus 36. A separate microcomputer 80 with its circuit board 246 is required for each elevator car in the system but adjacent HOISTWAY DATALINKS 82 may be interfaced by a single microcomputer 80 in the system.

It is conceivable that a particular building configuration could provide a hydraulic elevator car system in one hatchway for a relatively low building rise configuration while an adjacent hatchway in the building or in a taller portion of the building could be provided with a traction elevator drive with the hallway fixture of both systems being jointly served by the microprocessor 80 in the machine room 26 of the one elevator system. Both sets of hallway fixture equipment could also be jointly served from penthouse 19 location of the microcomputer 80 resident with the car controller 24 of the traction system so that if either microcomputer 80 fails, the remaining microcomputer 80 recognizes this situation and takes over and continues to serve the traffic pattern as far as it is able to in a compensating way for the failure of the other system components. A similar operating configuration is likewise available for two hydraulic car elevator bunk system.

Figure 8:
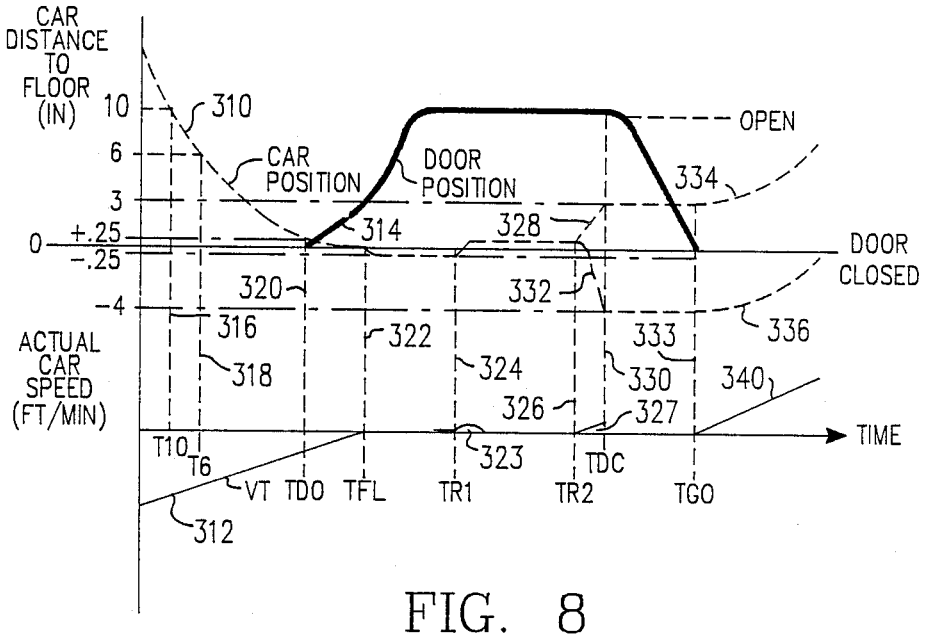
FIG. 8 is a graph illustrating certain car position versus time, car door and car transition relationships according to the invention.

Operation of the elevator system 10, according to the teachings of the invention, is graphically illustrated in FIG. 8 for certain relevant time consideration with respect to elevator car door opening and closing and car movement relationships while a car enters a terminal floor landing zone. Passenger entry and departure take place before the car begins to move to its next destination floor of the building, and curve 310 illustrates the car position relative to the floor level in the landing zone versus time. Curve 312 illustrates car speed VT versus time and curve 314 illustrates car speed VT versus time and versus time. The vertical broken lines 316, 318, and 320 indicate the times when the elevator car reaches the 10-inch, the 6-inch, and the 0.25-inch positions above floor level, which later occurs at broken line 322. The time indications T-10, T-6 and TFL have the corresponding meaning for same on the time axis.

The curve for the car speed 312 indicates that the car is in the process of slowing down from a maximum positive car speed 20 velocity VT to zero at floor level FL, as when the system is operating properly. In this example, the door position curve 314 indicates that the doors receive a signal to begin to open when the car position 310 is within +0.25 inch of the floor level on TFL. However, this pre-opening condition of the doors is merely illustrative of a possible signaling configuration where it is safe to begin the opening of the door before the elevator car 12 has actually been stopped at its car floor level precisely at the corridor floor level 15*a*, as when switching contacts Z1 in FIG. 6 begin to be held in their open contact position. This distance is chosen to be the releveling distance between car floor and hallway floor 15*a*, as when a deflection of the car of this character energizes the DST output channel 252 for the motor 52 and pump 50 to energize along with the DUP output channel 254 for the UP valves 58, to open, as shown in FIGS. 1, 6, to move the car upward. This is needed to balance the weight addition in the car which adds to the compression of the oil in the hydraulic jack. This is also the condition shown in FIG. 8 which is preceded by the car position deflection to −0.25 inch which begins to occur soon after TFL at dashed line 322 indicating added car weight. It is compensated for beginning at time TR1 at which time the velocity curve VT at rise 323 indicates a momentary increase in order to raise the car through the horizontal axis which serves as a time axis and also another functional purpose as designated DOOR CLOSED. The position for the doors 13*a* preceding dashed line 320 and following dashed line 336 indicates the doors are in some state of openness as shown by curve 324 therebetween.

The dashed curve 310 representative of car position with respect to time hypothetically increases along curve 328, during which time the hydraulic system may be responding to the expansion of hydraulic oil in the hydraulic jack 40 shown in FIG. 1 and the microcomputer 246 by signaling the DDN output channel 256 to energize both the DN relay coil 282 and coincidentally the DNA relay coil 284 to allow gravity to release the hydraulic oil past the valves 58 controlled thereby to flow back into the oil reservoir 48 of the hydraulic system. This facet of operation correspond to the elevator car becoming nearly empty or significantly diminished in weight previous in time to the compensation mentioned. The door of the elevator car may remain open until deflection passed the inner landing zone measurement of ±3.0 inches (76 mm) above and below the landing is exceeded, according to ANSI/ASME section 210.1e (7). The closing of the doors is not initiated in this interim between dashed line 330 for time TDC to 333 at time TGO because the car location may be compensated for within this measure of deviation. The compensation will likely take place within the 3-second interval of timing of LT coil 270 holding the LT-1 contacts 271 closed for the car to relevel within this time until at TGO the elevator car begins to accelerate away from the terminal floor as indicated by the car position curve 334 segment and the VT velocity curve portion 340.

A dashed curve portion 332 for car position represents the alternative situation from time TR2 to TDC at which time the car position has deviated below the maximum permissible code specification of 3 inches below the terminal floor which may be the situation when the car is loaded very rapidly by a large group of passengers or with extremely heavy objects being placed on the car. The compensating action for the compression for hydraulic oil described above does not take place in time to avoid the deflection becoming greater than 3 inches which indicates the position −4 inches below the terminal floor where the car floor is positioned. When the deflection has reached −3 inches below floor, the floor position is sensed by car switch pair 97, as shown in FIG. 1, which transition between the open state to the closed state to signal on the traveling cable 84*a* to the microcomputer circuit 246. The DLDU output channel 250 may no longer be signaled to close with LT relay 270 timing out the remaining portion of the previous 3-second interval becoming substantially expended before the car position deviates much farther. Therefore, at time TDC represented by dashed line 330, the doors begin to close and shut during the to time TGO, at which time the car is allowed to accelerate away from its position near terminal floor following car position curve 336. This begins within maximum vertical deflection of car position below the terminal floor which is still well within the ±6 inches maximum tolerable deflection of the car position from the terminal floor position. The elevator car in a hydraulic system is likely to move at a releveling speed of only about 10 feet per minute, so actually during the time out of LT relay coil 270 for a car moving with its doors open, the car is likely to move only about 6 inches maximum during the remaining portion of a time-out cycle. Any subsequent enabling of DLDU output channel 250 by the microcomputer circuit 246 not permitted to occur unless there is integrity of all relevant signals in the elevator system.

In summary, there has been disclosed a new and improved elevator system and method of operating same with a leveling safeguard control that will operate with a distributed control system which is partially located with each car and partially located remote therefrom, with bi-directional communications on a local area network from the remote location to the car and the corridor fixtures as in the hereinbefore-mentioned incorporated allowed U.S. application Ser. No. 06/829,744, filed Feb. 14, 1986. The invention drastically reduces the number of relay elements in both traction and hydraulic elevator system with the incorporation of a microprocessor based computer circuit implementing program control functions which incorporate elevator safety code operating requirements such as those that define that the elevator car or cab is not permitted to move beyond a limited distance away from a floor landing zone unless the doors are fully closed.

A time delay relay is provided in the controlling circuit branch which permits the elevator car to relevel within a predefined distance from a floor with its car doors open in order to compensate in a traction elevator system for the elevator rope stretching and shrinking with changes in the weight of the car with the passengers and objects aboard. Likewise in a hydraulic elevator system, the vertical movement of the car floor with respect to the corridor floor occurs at a landing where weight changes of the car with passengers and objects causes the compression or expansion of hydraulic oil in the telescoping hydraulic jack which drive the car. Safe and predictable operation of the elevator system during car releveling is provided by a time delay relay LT having a relatively short "time delay for on operation" after which time the car can no longer operate with its doors open. This ensures that a single component failure in an elevator system of the following types and others will not result in unsafe operation. The microprocessor controlled output channel for the door closed bypass circuit may not de-energize because of not receiving a deenergizing signal; failure may be in the output channel itself; an electrical short may occur; and, a microprocessor or software program failure may occur which would not be otherwise sufficient to derrogate the system operation to shutdown with a predictable execution. Any condition that causes the elevator system to attempt to move a car with the doors open for a period of time greater than the time out of the LT relay will be stopped by the operation of same, and the only way to move the elevator car once the time out has occurred is to either close the car doors and move the car back to the permitted zone or to de-energize and re-energize the associated output channel which would reset the timing relay for another brief interval of time-out within the landing zone.

We claim as our invention:

1. An elevator system leveling safeguard comprising:

a structure having a plurality of floors, each of said floors having an associated floor landing zone defined by a preset distance on either side of said floor, an elevator car mounted for movement in said structure to serve the floors, door means for said car having a door adapted to be controlled to open and close on signal, motive means for causing said elevator car to make a run and stop at a target floor, and control means including channel circuit means remotely located from said car and being adapted to shut down said car motive means upon failure of said control means, said control means being interactive with said motive means and with said door means including means for directing said elevator car to land and then remain at the target floor with its said door means signalled to open for door opening and remain open only within said floor landing zone, so that a failure of said control means after said door means has been signalled to open will result in the motive means causing the car to stop within the floor landing zone of the target floor without moving the car therebeyond in the door opened condition.

2. An elevator system leveling safeguard comprising:

a structure having a plurality of floors, each of said floors having an associated floor landing zone defined by a preset distance on either side of said floor, an elevator car mounted for movement in said structure to serve the floors, door means for said car having a door adapted to be controlled to open and close on signal, motive means for causing said elevator car to make a run and stop at a target floor, and control means being interactive with said motive means and with said door means including means for directing said elevator car to land and then remain at the target floor with its said door means signalled to open for door opening and remain open only within said floor landing zone, said control means including channel circuit means being energized for moving the car up or down in the door opened condition, said channel circuit means including safeguard means for shutting down said car motive means upon failure of said control means, so that a failure of said control means after said door means has been signalled to open will result in the motive means causing the car to stop within the floor landing zone of the target floor without moving the car therebeyond in the door opened condition.

3. The elevator system of claim 2, wherein said channel circuit means includes a normally open circuit path which is actuated to a closed circuit path in response to said control means signalling said channel circuit means that car leveling in the floor landing zone of the target floor should begin and with said door means signalled to the door opened condition.

4. The elevator system of claim 3, wherein said control means includes a remote controller connected in a circuit path over a traveling cable to local control means aboard said elevator car, said remote controller being located in a remote space at one vertical extremity of said structure for the elevator system, said traveling cable having a plurality of conductors to provide power, safety circuit and hand-control signals between said car and said machine room.

5. The elevator system of claim 4, wherein said remote controller includes a microprocessor based computer circuit adapted to interface signals over said traveling cable to and from said local control means, said local control means includes floor control circuit means controlled by said remote controller by communicating signal information serially with said computer circuit.

6. The elevator system of claim 2, wherein said safeguard means for shutting down said car motive means includes a time delay means, said time delay means having a condition of readiness to begin timing out, said ready condition occurs at the time when said channel circuit means becomes energized for moving the car up or down in the door opened condition, said time delay means begins to time out after energization of said channel circuit means from said control means so that within a preset time said car motive means becomes ineffective to move the car beyond the floor landing zone.

7. The elevator system of claim 6, wherein said channel circuit means is a microprocessor controlled output channel providing a normally open circuit path which closes when an appropriate signal is received by said output channel, said control means further including a remote controller connected in a circuit path over a traveling cable to local control means aboard said elevator car, said remote controller being located in a space provided at one vertical extremity of said structure for the elevator system, said a traveling cable having a plurality of conductors to provide power, safety circuit and hand-control signals between said car and the location of said remote controller.

8. The elevator system of claim 7, wherein said remote controller includes a microprocessor based computer circuit adapted to interface signals over said traveling cable to and from said local control means, said local control means including a floor control circuit means adapted to be controlled by said remote controller by serially communicating signal information with said computer circuit.

9. The elevator system of claim 2, wherein said channel circuit means is a microprocessor controlled first output channel providing a normally open circuit path which closes when an appropriate signal is received by said first output channel, said control means further including an upward car travel channel circuit means and a downward car travel channel circuit means connected in parallel circuit paths effective to be alternatively energized for respective upward and downward car leveling in the zone of a target floor, said upward and downward car travel channel circuits each including a microprocessor controlled output channel similar to said first output channel, said first output channel forming a closed circuit path through said safeguard means with said control means being actively in control and said closed circuit path being completed through one of the other of said upward and downward car travel channel circuits until the car is positioned level at the target floor with the door means signalled to the opened condition.

10. The elevator system of claim 9, wherein said safeguard means for shutting done said car motive means includes a time delay means, said time delay means having a condition of readiness to begin timing out, said ready condition occurs at the time when said first output channel of said channel circuit means becomes energized for moving the car up or down in the door opened condition, said time delay means begins to time out after energization of said first output channel by said control means so that after a present time said car motive means becomes ineffective to move the car beyond the floor landing zone.

11. A method for protecting an elevator system in the manner of a leveling safeguard in a structure having a plurality of floors, and method comprising:

providing each of said floors with an associated floor landing zone defined by a preset distance on either side of said floor, providing an elevator car mounted for movement in said structure to serve the floors, providing door means for said car having a door adapted to be controlled to open and close on signal, providing motive means for causing said elevator car to make a run and stop at a target floor, and providing control means interactive with said motive means and with said door means and directing said elevator car to land and then remain at the target floor with its said door means signalled to open for door opening and remaining open only within said floor landing zone, said interactive control means energizing, through a channel circuit means, the movement of the car up or down in the door opened condition, the channel circuit means providing safeguarding for shutting down the car motive means upon failure of the control means, so that a failure of said control means after said door mens has been signalled to open will result in the motive means causing the car to stop within the floor landing zone of the target floor without moving the car therebeyond in the door opened condition.

* * * * *